United States Patent [19]

Magherini

[11] 3,976,967

[45] Aug. 24, 1976

[54] ELECTRICAL PLUG WITH REPLACEABLE FUSES

[76] Inventor: Dino Magherini, Via Osservatorio 36, Florence, Italy

[22] Filed: Dec. 11, 1974

[21] Appl. No.: 531,819

[30] Foreign Application Priority Data

Dec. 12, 1973 Italy ..... 9719/73
Jan. 25, 1974 Italy ..... 9323/74

[52] U.S. Cl. ..... 337/211; 337/216; 337/264

[51] Int. Cl.[2] ..... H01H 85/22

[58] Field of Search ..... 337/256, 260, 261, 263, 337/264, 211, 213, 214, 215, 216, 412, 414

[56] References Cited

UNITED STATES PATENTS

| | | | |
|---|---|---|---|
| 2,636,097 | 4/1953 | Shapiro | 337/214 X |
| 2,910,625 | 10/1959 | Carpenter | 337/269 X |
| 3,018,350 | 1/1962 | Jensen | 337/213 X |
| 3,163,728 | 12/1964 | Martin | 337/216 X |
| 3,198,912 | 8/1965 | Savoca et al. | 337/214 X |
| 3,810,077 | 5/1974 | Salzer | 337/215 X |
| 3,813,626 | 5/1974 | Cetola | 337/264 X |

*Primary Examiner*—George Harris
*Attorney, Agent, or Firm*—Haseltine, Lake & Waters

[57] ABSTRACT

An electrical connector plug comprising a body containing first electrical connector elements adapted for electrical connection with an electrical device and second electrical connector elements adapted for electrical connection with an electrical power source. Electrical fuses are replacably mounted in a carrier casing which is pivotably moveable between a first operative position in which the fuses electrically connect the first and second connector elements and a second inoperative position in which the first and second connector elements are disconnected and the fuses are accessible for removal and replacement. The carrier casing can carry replacement fuses.

19 Claims, 10 Drawing Figures

FIG. 6
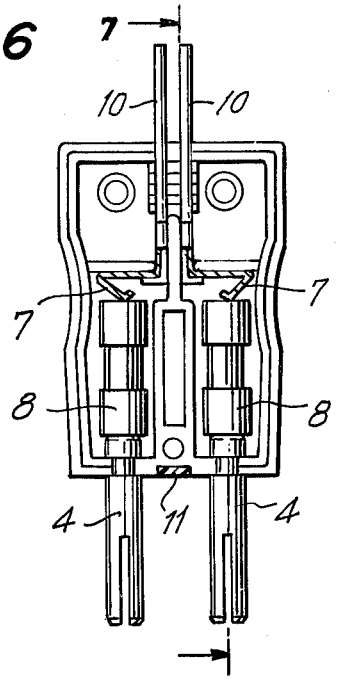
FIG. 7
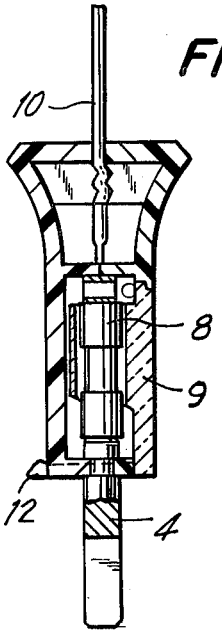
FIG. 8
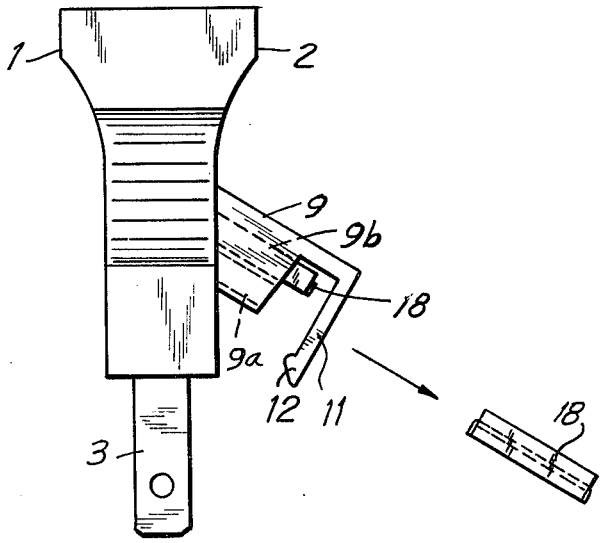
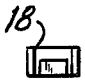
FIG. 9
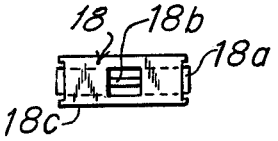
FIG. 10

ELECTRICAL PLUG WITH REPLACEABLE FUSES

FIELD OF THE INVENTION

The invention relates to an electrical connector plug containing removable fuses.

BACKGROUND AND SUMMARY OF THE INVENTION

Connector plugs are known in which fuses are contained in an accessory coupled therewith.

An object of the inventon is to provide a connector plug in which the fuses are internally contained and are rapidly and simply replaced without danger of accidental electrical contact.

In accordance with the invention, there is provided an electrical connector plug comprising a body, first electrical connector elements mounted in said body for electrical connection with an electrical device, second electrical connector elements mounted in said body for electrical connection with an electrical power source, and means replaceably supporting electrical fuses in said body between said first and second connector elements to establish connection therebetween.

The means which supports the fuses comprises a carrier casing mounted in said body for movement between an operative inserted position in which the fuses electrically connect the first and second connector elements and an inoperative retracted position in which the first and second connector elements are disconnected and the fuses are accessible for removal and replacement.

Preferably the carrier casing is pivotably mounted in the body for movement between said retracted and inserted positions.

The body is substantially cylindrical and the carrier casing in the retracted position is disposed within a notch in the body to complete the cylindrical outline thereof.

The carrier casing is preferably transparent to enable viewing of the fuses from outside the body. The carrier casing carries a resilient tongue with a hook at its free end adapted for releaseably locking the carrier casing to the body in the inserted position of said carrier casing.

According to a further feature of the invention, the carrier casing is provided with compartments receiving said fuses and with further compartments receiving spare fuses. Preferably the compartments and fuses have corresponding shapes enabling only fuses of the same shape to be inserted into the compartments.

According to a further feature of the invention, the compartments are inaccessibly incorporated within the outline of the body in the inserted operative position of the carrier casing within said body.

The invention will be described hereafter in relation to specific embodiments thereof with reference to the following detailed description and the appended drawings.

BRIEF DESCRIPTION OF THE DRAWING

FIG. 6 is a section taken along line 6—6 in FIG. 5;

FIG. 7 is a section taken along line 7—7 in FIG. 6;

FIG. 8 is a side elevation view of a modified embodiment of a plug;

FIG. 9 is an end view of the plug of FIG. 8; and

FIG. 10 is a plan view of the plug of FIG. 8.

DETAILED DESCRIPTION

Figure 1:
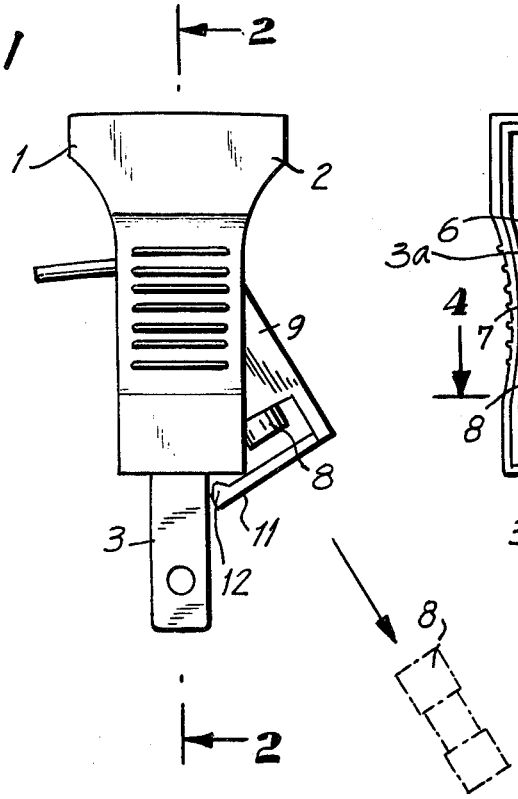
FIG. 1 is a side elevation view of a plug with flat pins according to the invention.
Figure 2:
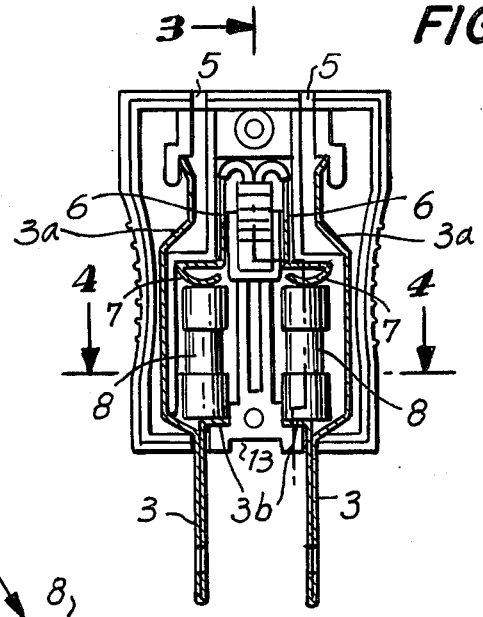
FIG. 2 is a section taken along line 2—2 in FIG. 1.

Referring to the drawing therein is shown in FIGS. 1–4 a first embodiment of an electrical connector plug which comprises a box-like insulating body composed of an assembly of two half-sections 1 and 2. These sections are provided with aligned apertures 21 and 22 through which suitable attachment fasteners (not shown) can be passed. Section 2 is provided with a notch 23, the purpose of which will become apparent later.

Figure 4:
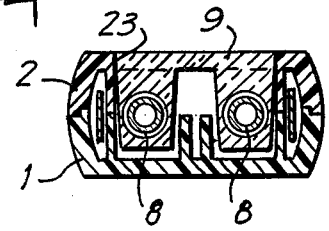
FIG. 4 is a section taken along line 4—4 in FIG. 2.
Figure 5:
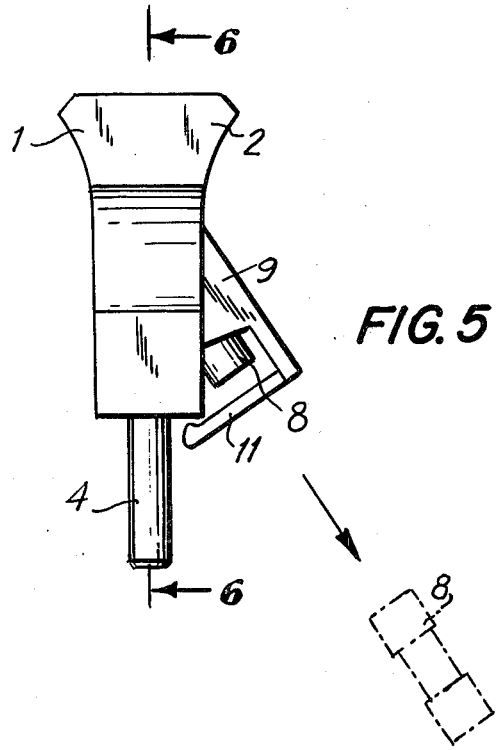
FIG. 5 is a side elevation view of a modified embodiment of a plug with round pins according to the invention.

Extending from the body are two pins which in the case of the embodiment of FIG. 1–4 are flat pins 3, whereas in the embodiment of FIGS. 5–7 they are round pins 4.

Each of the pins 3 is provided with a double internal connection in the body by means of first connectors **3*a* and second connectors 3*b*. Connectors 3*a* are adapted to be placed into electrical contact with the pins of a second connector plug inserted in slots 5 in the body aligned with pins 3. Connectors 3*b* are secured in the body for making electrical connection with one end of fuses 8**.

Third electrical connectors 6 are mounted within the body and are formed with spring terminals 7 adapted for being placed into electrical contact with the opposite ends of the fuses 8 without any arcing therebetween. In the particular embodiment, the connectors 6 are adapted for connection with electrical lead lines 10 extending to an electrical device which is to be electrically powered through the plug.

The fuses 8 are of the interchangeable cylinder type and they are arranged as a pair and mounted in a carrier casing 9 so as to be removeably inserted between the connectors **3*b* and the terminals 7**.

The carrier casing 9 is made of rigid electrically insulative material and is pivotal in said body around hinge 30 for movement between an operative inserted position in notch 23 in which the fuses 8 are in electrical contact with the connector elements **3*b* and 6, and an inoperative retracted position in which the aforesaid connector elements are disconnected and the fuses 8** are accessible for removal and replacement.

Figure 3:
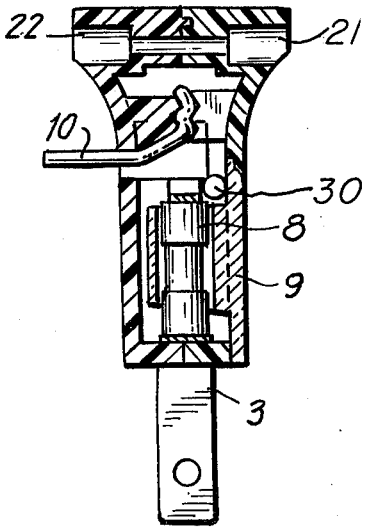
FIG. 3 is a section taken along line 3—3 in FIG. 1.

FIG. 1 shows the carrier casing 9 in retracted inoperative position while FIGS. 3 and 4 show the carrier casing in inserted operative position. It is to be noted that in the operative position, the carrier casing 9 completes the essentially cylindrical outline of the body 1 by entering notch 23 formed in section 2 of the body.

The carrier casing 9 has an elastic tongue 11 which is provided with a hook 12 at its free end. In the inserted operative position of the carrier casing, the tongue 11 extends in a groove 13 formed in the body so that the hook 12 can engage section 1 of the body and releasably lock the carrier casing in the operative position.

The embodiment of FIGS. 5–7 is similar to that described hereinabove, and the same elements are designated by the same reference numerals. As previously stated, in the embodiment of FIGS. 5–7, the pins are flat rather than round as in the embodiments of FIGS. 1–4. Additionally, the mounting of electrical lead lines 10 is somewhat modified insofar that these are coaxial with the plug instead of extending laterally as in the aforesaid embodiment. Moreover, the provision of slots for reception of the pins of a second plug have not been shown, although these can be readily arranged within the body in the manner as disclosed in the aforesaid embodiment. Additionally, the securing of the two sections 1, 2 of the body is slightly modified insofar that the fasteners are located on opposite sides of the center line of the plug as contrasted with the centered arrangement shown in the first embodiment.

In both embodiments, the carrier casing is preferably transparent so that the condition of the fuses can be viewed from outside the plug.

The operation of the plug is as follows.

The condition of fuses 8 is determined either by externally viewing the same through the transparent casing 9, or the casing is retracted to inoperative position and the fuses are examined. When operative fuses are positioned in the carrier casing 9, the casing is brought to its inserted operative position by pivoting the casing inwardly into the body, and the hook 12 is locked in place to secure the carrier casing in its operative position. Thereby the fuses 8 are brought into contact with connectors **3*b* and terminals 7 to close the electrical circuit between the electrical lead lines 10 and the pins. Thereafter, the pins of the plug can be inserted into the slots of an electrical outlet, whereupon the electrical lead lines 10** are made live.

To replace one or both fuses, the carrier casing 9 is brought to its retracted inoperative position after unlocking hook 12 from section 1, and the fuses 8 are allowed to fall from the supporting compartments in the carrier casing. New fuses are introduced into the compartments, and the carrier casing is returned to its inserted operative position. The condition of the fuses can be readily checked visually through the transparent material of the carrier casing.

Instead of the arrangement as shown in FIGS. 1–7, the pins could be eliminated in favor of slots in which the pins of a conventional electrical plug could be inserted. These pins would be placed into contact with connectors **3*b*, and into electrical circuit with electrical lead lines 10 through the fuses 8. However, in this case, the lead lines 10 would extend to an electrical power source, for example, by means of a conventional plug inserted into an electrical outlet. In such arrangement, the outlet of the plug at terminals 3*b* would be connected to the power through fuses 8.**

In the embodiments of FIGS. 1–7, the fuses are shown as conventional cylinder-type fuses. In replacement of these fuses it becomes possible for the user to inadvertently introduce a fuse of the same size but with different power rating which could adversely affect the circuit utilizing the plug. In the case of lower rated fuses, disconnection would be made at operating currents lower than the rated values, while in the case of higher rated fuses, the circuit would not be disconnected even with excess current exceeding the rated values.

FIG. 8 shows an embodiment in which the fuses are of particular shape so as to exclude their interchangability with conventional fuses. The carrier casing is provided with correspondingly shaped compartments **9*a* to accept only the specifically shaped fuses. Additionally, the carrier casing is provided with additional compartments 9*b*** in which spare fuses are supported.

In FIG. 8 the active fuses 18 which are inserted into compartments **9*a* are of parallelepiped shape which is prismatic in cross-section, preferably rectangular. The compartments 9*b* for carrying the spare fuses overlie corresponding compartments 9*a*.**

The fuses comprise electroconductive metal blades **18*a* whose free ends are bare and are intended to make respective electrical connection with the connector 3*b* of a corresponding pin and the terminal 7 of a corresponding connector 6, and a central portion 18*b* which is suitably gaged to melt under the heat produced by a current exceeding the rated value. A shell 18*c* of insulating material, preferably transparent, encloses the blades and central portion 18*b*.**

Numerous modifications and variations of the disclosed embodiments will become apparent to those skilled in the art & without departing from the scope and spirit of the invention as defined in the appended claims.

What is claimed is:

1. An electrical connector plug comprising a body, first electrical connector elements mounted in said body for electrical connection with an electrical device, second electrical connector elements mounted in said body for electrical connection with an electrical power source, means replaceably supporting electrical fuses in said body between said first and second connector elements to establish electrical connection there between, external pin means mounted on said plug in electrical connection with said second connector elements for being inserted in the slots of an electrical power outlet, said means supporting the fuses comprising a carrier casing and a hinge pivotably mounting said casing in said body for movement between an operative inserted position in which the fuses electrically connect the first and second connector elements, and an inoperative retracted position in which the first and second connector elements are disconnected and the fuses are free of electrical connection and are accessible outside said body for removal and replacement, whereby said pin means can remain in the slots of the electrical power outlet and the fuses can be handled while disconnected from electrical power.

2. An electrical connector plug as claimed in claim 1, wherein said pin means comprises pins.

3. An electrical connector plug as claimed in claim 1, wherein said body is elongate and has one end with said pin means, said body having a recess, said carrier casing in said inserted position projecting within said recess and having an outer wall forming a continuous contoured closure with said body.

4. An electrical connector plug as claimed in claim 3, wherein said carrier casing includes rectangular projections having respective apertures therein in which said fuses are contained.

5. An electrical connector plug as claimed in claim 4, wherein said body has a central median plane, said fuses being disposed in said plane with the carrier casing in inserted position.

6. An electrical connector plug as claimed in claim 1 comprising locking means for releasably locking said carrier casing in said body in said inserted position.

7. An electrical connector plug as claimed in claim 1 wherein said carrier casing is constituted of transparent material to enable viewing of the fuses from outside the body.

8. An electrical connector plug as claimed in claim 1 wherein said carrier casing and said body are constituted of electrically insulative material.

9. An electrical connector plug as claimed in claim 2 comprising further electrical connectors in said body in electrical contact with said pins, said body being provided with slots associated with said further electrical connectors to provide electrical connection between said pins and the pins of a second plug inserted into said slots in the body.

10. An electrical connector plug as claimed in claim 1 wherein said first connector elements are resilient terminal elements mounted in said body in resilient contact with said fuses and adapted for connection with electrical leads extending externally of the body for connection with the electrical device.

11. An electrical connector plug as claimed in claim 2 wherein said pins are round.

12. An electrical connector plug as claimed in claim 2 wherein said pins are flat.

13. An electrical connector plug as claimed in claim 1 wherein said body is constituted of rigid, self-extinguishing synthetic plastic material.

14. An electrical connector plug as claimed in claim 1 further comprising means supporting inactive replacement fuses in said body.

15. An electrical connector plug as claimed in claim 14 wherein said fuses are of parallelepiped shape.

16. An electrical connector plug as claimed in claim 14 wherein said fuses are of prismatic shape.

17. An electrical connector plug as claimed in claim 1 wherein said carrier casing is provided with compartments receiving said fuses and with further compartments receiving inactive replacement fuses.

18. An electrical connector plug as claimed in claim 17 wherein said compartments and fuses have corresponding shapes enabling only fuses of the same shape to be inserted thereinto.

19. An electrical connector plug as claimed in claim 17 wherein said further compartments are inaccessibly incorporated within the outline of said body, in the inserted operative position of said carrier casing.

* * * * *